United States Patent [19]

Hosaka

[11] Patent Number: 5,068,794

[45] Date of Patent: Nov. 26, 1991

[54] SYSTEM AND METHOD FOR COMPUTING ASYNCHRONOUS INTERRUPTED FUEL INJECTION QUANTITY FOR AUTOMOBILE ENGINES

[75] Inventor: Hiroshi Hosaka, Tokyo, Japan

[73] Assignee: Fuji Jukogyo Kabushiki Kaisha, Tokyo, Japan

[21] Appl. No.: 513,841

[22] Filed: Apr. 24, 1990

[30] Foreign Application Priority Data

Apr. 28, 1989 [JP] Japan ..... 1-110566

[51] Int. Cl.[5] ..... F02M 51/00

[52] U.S. Cl. ..... 364/431.05; 364/431.07; 123/478; 123/492

[58] Field of Search ..... 364/431.05, 431.07; 123/478, 492, 493, 480

[56] References Cited

U.S. PATENT DOCUMENTS

| | | | |
|---|---|---|---|
| 4,490,792 | 12/1984 | Deutsch et al. | 364/431.07 |
| 4,800,860 | 1/1989 | Nanyoshi et al. | 123/492 |
| 4,858,136 | 8/1989 | Tanaka et al. | 364/431.05 |
| 4,866,620 | 9/1989 | Abe et al. | 364/431.05 |
| 4,897,791 | 1/1990 | Sekozawa et al. | 364/431.05 |
| 4,915,078 | 4/1989 | Sonoda et al. | 123/478 |
| 4,919,100 | 4/1990 | Nakamura | 123/492 |
| 4,947,816 | 8/1990 | Nakaniwa et al. | 123/478 |
| 4,974,563 | 12/1990 | Ikeda et al. | 123/492 X |
| 4,987,888 | 1/1991 | Funabashi et al. | 364/431.07 X |

*Primary Examiner*—Parshotam S. Lall
*Assistant Examiner*—Thomas S. Auchterlonie
*Attorney, Agent, or Firm*—Beveridge, DeGrandi & Weilacher

[57] ABSTRACT

A fuel injection control system for an automotive engine, including a device which, before an intake stroke cycle, estimates what an estimated throttle opening degree and an estimated engine speed will be for the engine after a predetermined time period in the intake stroke cycle has lapsed, based on the throttle opening degree and engine speed and calculates a first fuel injection quantity to be injected before an intake stroke cycle, and a device which, during the intake stroke cycle, calculates a second fuel injection quantity and computes an asynchronous interrupted fuel injection quantity to be injected during the intake stroke cycle, based on the difference between the first and second fuel injection quantity.

14 Claims, 7 Drawing Sheets

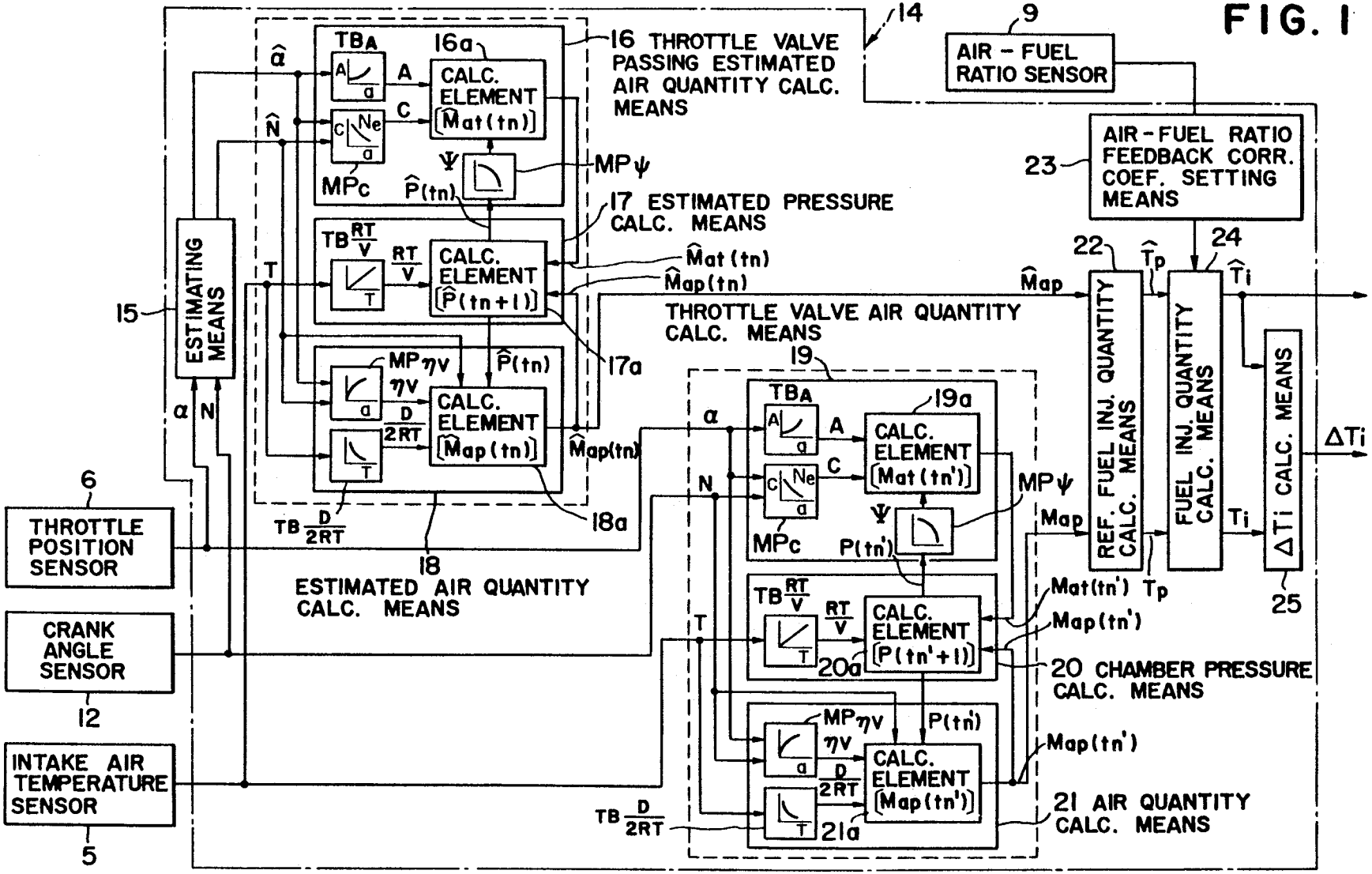
FIG. 1
AIR - FUEL RATIO SENSOR
9
AIR-FUEL RATIO FEEDBACK CORR. COEF. SETTING MEANS
23
14
16 THROTTLE VALVE PASSING ESTIMATED AIR QUANTITY CALC. MEANS
17 ESTIMATED PRESSURE CALC. MEANS
THROTTLE VALVE AIR QUANTITY CALC. MEANS
19
REF. FUEL INJ. QUANTITY CALC. MEANS
22
FUEL INJ. QUANTITY CALC. MEANS
24
ΔTi CALC. MEANS
25
ΔTi
20 CHAMBER PRESSURE CALC. MEANS
21 AIR QUANTITY CALC. MEANS
ESTIMATED AIR QUANTITY CALC. MEANS
18
ESTIMATING MEANS
15
THROTTLE POSITION SENSOR
6
CRANK ANGLE SENSOR
12
INTAKE AIR TEMPERATURE SENSOR
5

FIG. 7A
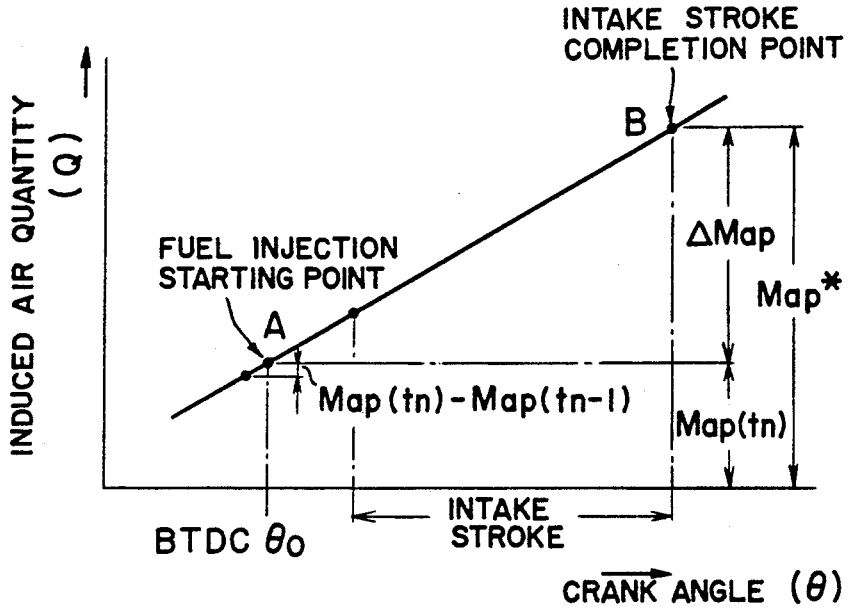
FIG. 7B
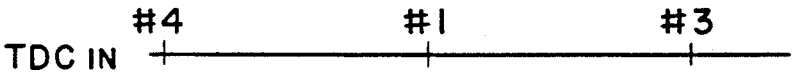
PRIOR ART
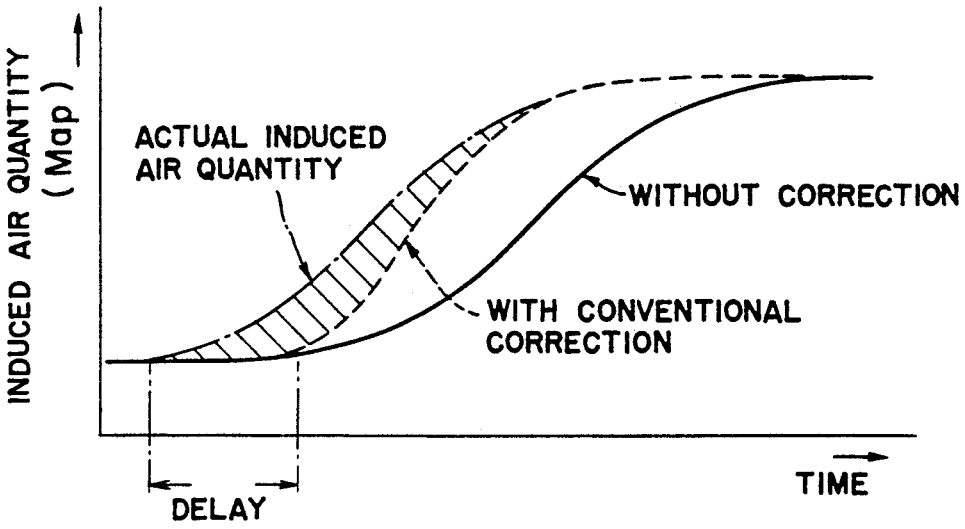
FIG. 8 PRIOR ART

SYSTEM AND METHOD FOR COMPUTING ASYNCHRONOUS INTERRUPTED FUEL INJECTION QUANTITY FOR AUTOMOBILE ENGINES

BACKGROUND OF THE INVENTION

The present invention relates to a fuel injection control system for an automobile engine to calculate a fuel injection quantity from an air induced quantity in cylinders of the engine in dependency on a throttle opening degree and an engine speed.

Generally, in the fuel injection control system of the type described above, a basic injection quantity Tp is first calculated with an induced air quantity and an engine speed as parameters and an actual fuel injection quantity Ti is then calculated by correcting the basic injection quantity Tp with various factors for the correction.

The induced air quantity is measured by an induced air quantity sensor arranged on a directly downstream side of an air cleaner in a L-jetronic system. On the other hand, the induced air quantity is estimated in response to the throttle opening degree ($\alpha$) and the engine speed (N) in a so-called "$\alpha$-N" system. The "$\alpha$-N" system makes simple or compact the engine unit and, hence, is superior from the viewpoint of economics because of fewer problems. In these advantageous view points, the "$\alpha$-N" system is widely used for various types of the engine units.

The air quantity induced into the cylinder has a time-lag of first order with a certain time constant. The time-lag of first order occurs according to a lag of changing an intake manifold with air. The induced air quantity estimated in response to the throttle opening degree and the engine speed at a transient state takes a value larger than an actual air quantity in the cylinder and, hence, an air-fuel ratio becomes rich when the throttle valve is rapidly opened at the transient state.

Particularly, in an MPI (multi-point injection) type engine, a calculation timing of the fuel injection quantity supplied into the respective cylinders is set just before the intake stroke, that is an intake valve is about open. So that, at the transient state wherein the induced air quantity is changed during the intake stroke, there occurs a difference between the induced air quantity at the calculation timing of the fuel injection quantity and the air quantity in the cylinder at the completion of the intake stroke. The difference adversely affects air-fuel ratio control characteristics.

In order to obviate such defect, the Japanese Patent Laid-open Publication No. 60-43135 discloses a system wherein an actual air quantity induced into the cylinder is estimated in dependency on the throttle opening degree at the initial stage of the transient state and the engine speed. The fuel injection quantity is changed with the time-lag of first order, so as to reach the fuel injection quantity corresponding to the estimated induced air quantity. Thus, an improvement in the air-fuel ratio control characteristics is attempted.

However, in the described prior art, there is no disclosure of means for estimating the required induced air quantity in dependency on the throttle opening degree and the engine speed.

In another aspect, in a prior application of the same applicant of the present application (Japanese Patent Application No. 63-257645), there is disclosed a system wherein an induced air quantity at this moment is first obtained in dependency on the throttle opening degree and the engine speed. Then the obtained air quantity is corrected by the correction factor depending on the subtracted difference between the obtained air quantity and the preliminarily obtained air quantity. Thus, the intake air quantity approximate to the actual air quantity induced in the cylinder is obtained.

Thus, as shown in FIG. 7, an estimated intake air quantity Map* set at a fuel injection point A of the first cylinder of BTDC$\theta$0 (for example, BTDC 80° CA) before the intake stroke an induced air increasing quantity Map at an intake stroke completion point B is primarily estimated in dependency on the difference between an induced air quantity Map(tn) calculated from the throttle opening degree and the engine speed at the point A and the induced air quantity Map(tn−1) in the preceding cycle. A value obtained by adding the induced air quantity Map(tn) to the estimated induced air increasing quantity Map is the estimated induced air quantity Map* at the fuel injection point A. A basic fuel injection quantity Tp is calculated from the estimated induced air quantity Map* and a desired air-fuel ratio A/F as ($Tp=Map^*/A/F$).

However, an acceleration of an engine equipped with more than four cylinders always starts on the intake stroke of a certain one cylinder and, hence, the aforementioned difference between the calculated air quantity and the actually induced quantity is caused in the present intake stroke of the certain cylinder. Therefore, an induced air quantity becomes lean by a quantity corresponding to a portion shown with hatching lines in FIG. 8.

Such a difference will be also caused during a deceleration cycle as a reverse phenomenon.

As a result, the air-fuel ratio control characteristics at the initial stage of the transient state becomes worse and a good response is not achieved. Moreover, the exhaust gas emission at the transient state becomes worse and, hence, the load to the catalyst increases.

SUMMARY OF THE INVENTION

An object of the present invention is to substantially improve defects or disadvantages encountered in the prior art and to provide a system for controlling fuel injection of an automobile engine capable of supplying fuel injection quantity corresponding to air quantity in a cylinder at the completion timing of an intake stroke even in an initial stage of a transient state as well as in a transient operation, thus improving a transient response and load applied to a catalyst.

This and other objects can be achieved according to the present invention by providing a system for controlling fuel injection of an engine having a cylinder, an intake passage, a throttle valve provided in the intake passage and a fuel injector. The system comprises: means for detecting a first engine speed with respect to a first reference crank angle before an intake stroke of the engine and a second engine speed with respect to a second reference crank angle on the intake stroke; means for detecting a first throttle opening degree with respect to the first reference crank angle and a second throttle opening degree with respect to the second reference crank angle; means for estimating a throttle opening degree and an engine speed in accordance with the first throttle opening degree and the first engine speed; means for calculating a first air quantity in the cylinder during the intake stroke with the first throttle opening degree and the first engine speed; means for calculating a first air quantity in the cylinder during the intake stroke with the first throttle opening degree and the first engine speed; means for calculating a second air quantity in the cylinder in accordance with the second throttle opening degree and the second engine speed; means for calculating a first fuel injection quantity in accordance with the first air quantity in the cylinder and a second fuel injection quantity in accordance with the second air quantity in the cylinder calculated by said air quantity calculating means so as to start the injection of the first quantity at the first reference crank angle; and means for calculating asynchronous interrupted fuel injection quantity in accordance with a difference value between the first and second fuel injection quantities calculated by said fuel injection calculating means so as to carry out the injection of the difference value at the second reference crank angle.

In a preferred embodiment of the present invention, the control system further comprises a unit arranged in association with the fuel quantity calculating means for setting an air-fuel ratio feedback correction coefficient and also comprises means for estimating a throttle opening degree and an engine speed in accordance with the first throttle opening degree and the first engine speed so as to transmit estimated results to the first air quantity calculating means.

According to the fuel injection control system of the engine described above, a throttle opening degree and an engine speed are primarily estimated with respect to the reference crank angle before the intake stroke and the estimated air quantity in the cylinder is calculated in the intake stroke with the estimated throttle valve opening degree and the engine speed as parameters. In addition, the air quantity in the cylinder is calculated in accordance with the throttle valve opening degree and the engine speed with respect to the reference crank angle on the intake stroke. The fuel injection quantities are calculated in accordance with the estimated air quantity in the cylinder so as to start the injection at the crank angle before the intake stroke quantity in the cylinder. Another fuel injection quantities are calculated in accordance with the air quantity in the cylinder. The asynchronous interrupt fuel injection quantity is calculated on the basis of the difference between both the fuel injection quantities.

Accordingly, it will be possible to supply the fuel injection quantity corresponding to air quantity in the cylinder in the completion of the intake stroke even in an initial stage of the transient state as well as during the transient operation. Thus, the transient response, the exhaust gas emission and the load to be applied to a catalyst are improved.

The other objects and features of the present invention will become understood from the following description with reference to the accompanying drawings.

BRIEF DESCRIPTION OF THE DRAWINGS

FIG. 1 is a block diagram of a fuel injection control system according to the present invention;

FIGS. 7A and 7B are graphs showing a fuel injection quantity estimation based on a conventional technology; and FIG. 8 shows a graph representing a delay of air quantity in a cylinder based on the conventional technology.

DESCRIPTION OF THE PREFERRED EMBODIMENT

FIGS. 1 to 6 represent one embodiment according to the present invention.

Figure 3:
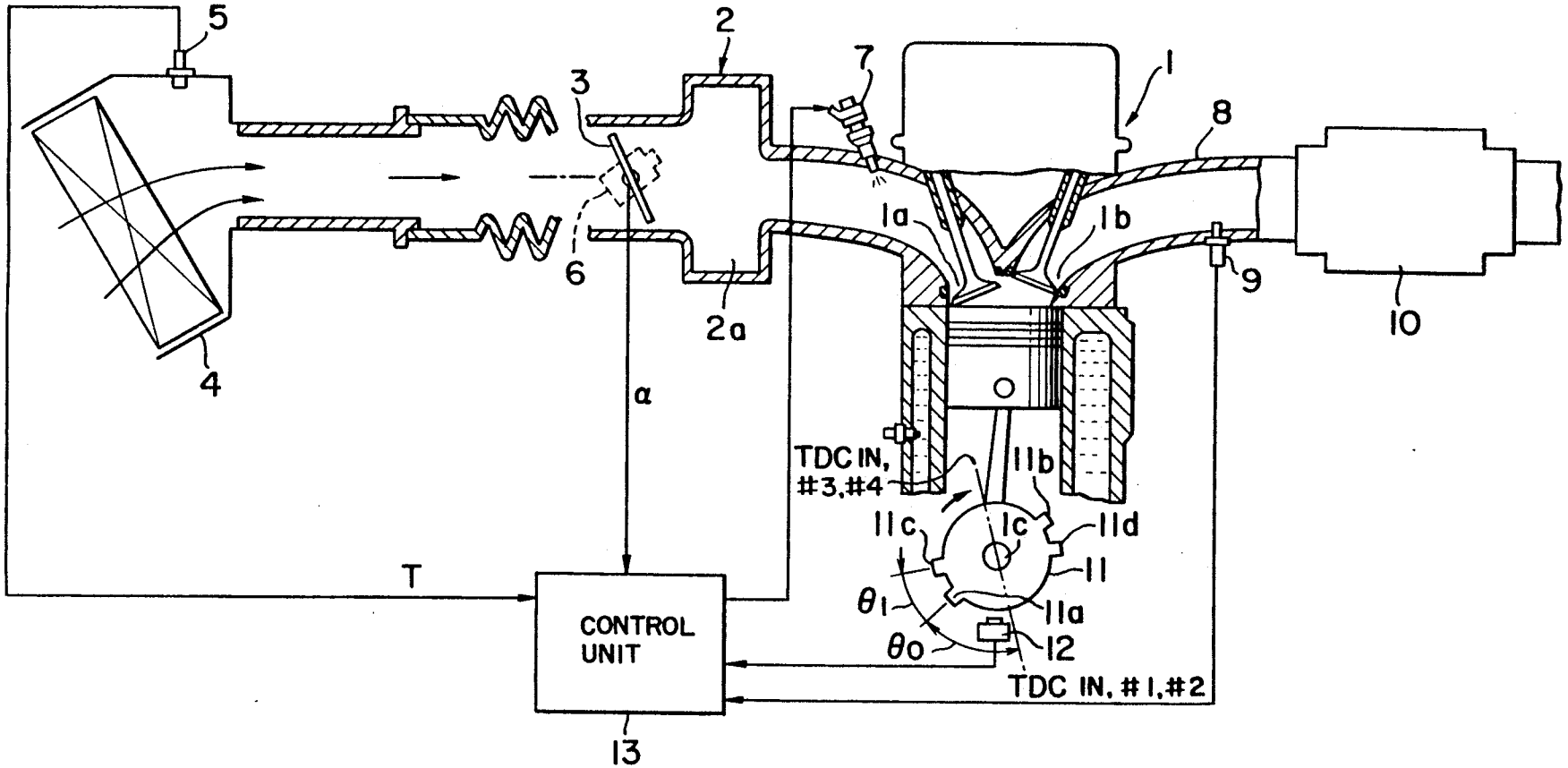
FIG. 3 is a schematic sectional view of an engine control system.

Referring to FIG. 3 showing a schematic arrangement of a fuel injection control system of an automobile engine, an engine 1 is provided with an intake port 1*a* with which an intake passage 2 communicates. A throttle valve 3 is assembled in the intake passage 2, and an air chamber 2*a* is formed between the throttle valve 3 and the intake port 1*a*. An air cleaner 4 is provided at an upstream side of the intake passage 2.

An intake air temperature sensor 5 is mounted to an expanded chamber of the air cleaner 4. A sensor 6 for detecting an opening degree of the throttle valve 3 is mounted thereto. An injector 7 having a nozzle directed to the intake port 1*a* is arranged downstream of the intake passage 2.

The engine 1 is also provided with an exhaust port 1*b* with which an exhaust pipe 8 communicates. A sensor 9 for detecting an air-fuel ratio is mounted to the exhaust pipe 8. A catalyst means 10 is disposed downstream of the air-fuel ratio sensor 9.

The engine 1 also includes a crank shaft 1*c* to which a crank rotor 11 is mounted. A plurality of projections 11*a* to 11*d* are formed on the outer periphery of the crank rotor 11. A crank angle sensor 12 is arranged at a portion opposing to the crank rotor 11.

In FIG. 3, only the #1 cylinder of the four-cylinder engine is shown. The projections 11*a* and 11*b* represent a reference crank angle $\theta_0$ (for example, $\theta_0$=BTDC 80° CA) with respect to the #1 and #2 cylinders and the #3 and #4 cylinders, respectively. Accordingly, an opening angle between the projections 11*a* and 11*b* is 180°. An angle $\theta_1$ is formed between the projections 11*a* and 11*c* and the projections 11*b* and 11*d*. An engine speed N is calculated from an angular speed by detecting the angle $\theta_1$.

The projection 11*a* designates a reference crank angle REF1 before the intake stroke representing the fuel injection start timing with respect to the #1 and #2 cylinders. And the projection 11*a* also designates a reference crank angle on the intake stroke with respect to the #3 and #4 cylinders. Furthermore, the projection 11*b* designates a reference crank angle REF2 before the intake stroke representing the fuel injection timing with respect to the #3 and #4 cylinders and also designates a reference crank angle on the intake stroke with respect to the #1 and #2 cylinders (see FIGS. 5B and 5C).

In FIG. 3, reference numeral 13 designates a control unit. A fuel injection control means 14 of the control unit 13 shown in FIG. 1 comprises estimating means 15, means 16 for calculating an estimated quantity of the air passing the throttle valve 3, means 17 for calculating an estimated pressure in the air chamber 2*a*, means 18 for calculating an estimated air quantity in the cylinder, means 19 for calculating an air quantity passing the throttle valve 3, means 20 for calculating a pressure in the air chamber 2a, means 21 for calculating an air quantity in the cylinder, means 22 for calculating a reference fuel injection quantity, means 23 for setting an air-fuel ratio feedback correction coefficient, means 24 for calculating a fuel injection quantity, and means 25 for calculating an asynchronous fuel injection quantity (ΔTi).

A fuel injection quantity Ti and the asynchronous injection quantity ΔTi are set to the cylinders, respectively. The quantities (Ti, ΔTi) will be referred to with respect to the #1 cylinder hereunder for the sake of convenience.

Figure 4:
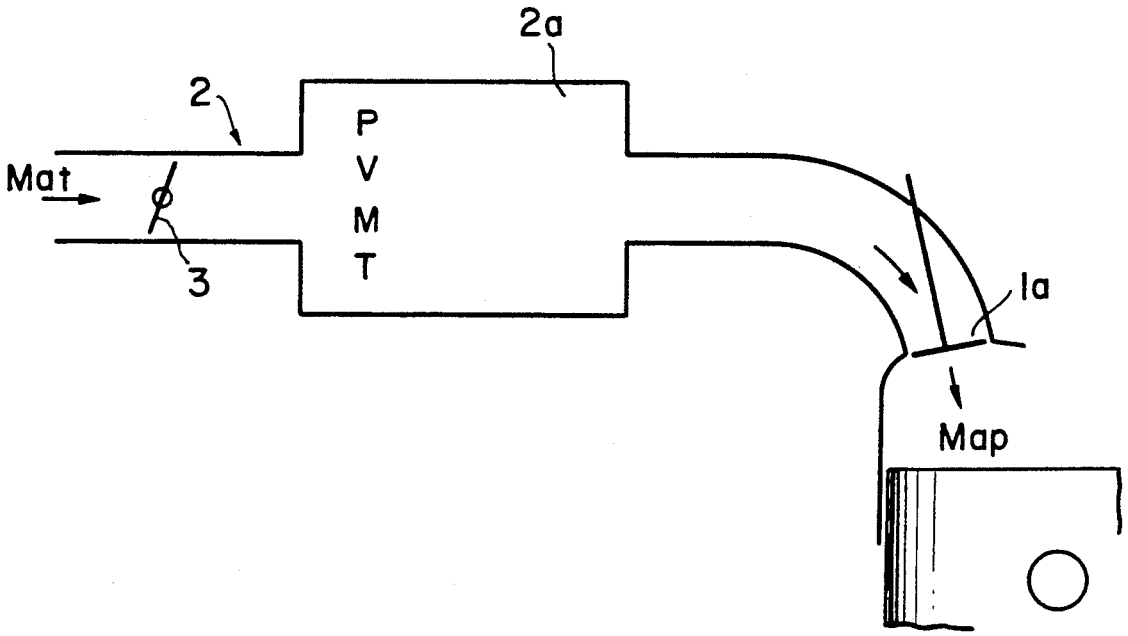
FIG. 4 is a schematic illustration showing an intake state.

FIG. 4 represents a model of an intake system. Referring to FIG. 4, an air quantity per unit time dM/dt in the chamber 2a of the intake passage 2 is represented by a difference between an induced air quantity Mat (throttle valve passing air quantity) and an air quantity fed to the cylinder (air quantity in the cylinder).

The air quantity per unit time is represented as $$dM/dt = Mat - Map \quad (1)$$

The equation of state in the chamber 2a is $$P \cdot V = M \cdot R \cdot T \quad (2).$$

where

P: inner pressure
V: inner volume
M: air quantity
R: gas constant
T: intake air temperature From the above equations (1) and (2), an inner pressure per unit time dP/dt in the chamber 2a is calculated as $$dP/dt = R \cdot T \cdot (Mat - MaP)/V \quad (3).$$

Assuming that the gas constant R and the inner volume V in the equation (3) above are constant, R·T/V becomes a function with respect to the intake air temperature T. Accordingly, the quantity of air Map in the cylinder can be calculated in accordance with the values of the throttle valve passing air quantity Mat, the chamber pressure P and the intake air temperature T.

The estimating means 15 in FIG. 1 operates in the following manner. An estimated throttle valve opening degree $\hat{\alpha}$(tn), and an estimated engine speed $\hat{N}$(tn) after a delay time (Td) in response to a present throttle valve opening degree α(tn) detected by the throttle valve opening degree sensor 6 as well as a present engine speed N(tn) detected by the crank angle sensor 12 are calculated in accordance with the following equation when a signal representing the reference crank angle (REF 1) before the intake stroke is output from a crank angle sensor 12 for detecting the projection 11a of the crank rotor 11.

The delay time (Td) means a time lapsed for a predetermined period from an angle of the fuel injection start timing to an angle corresponding to the middle of the intake stroke so as to be calculated in dependency on the engine speed. Almost all of the air quantity induced in the cylinder of the engine 1 is induced at the middle of the intake stroke.

$$\hat{S}(tn) = S(tn) + \frac{Td}{t}(S(tn) - S(tn-1)) \quad (4)$$

-continued $$Td = f(N)$$

where

S: α or N
t: calculation cycle
tn: the present cycle of time
(tn−1): preceding cycle of time Thus, a variation of the throttle valve opening degree or a variation of the engine speed after a certain time is calculated in the second term of the right side in the equation (4) and the throttle valve opening degree α(tn) or the engine speed N(tn) after a certain time is estimated by adding the present throttle valve opening degree α(tn) or the present engine speed N(tn) in the first term of the right side to the variation.

In a calculating element 16a of the throttle valve passing estimated air quantity calculating means 16, an estimated quantity of air $\hat{M}$at(tn) passing the throttle valve is calculated from the estimated throttle valve opening degree $\hat{\alpha}$(tn) and the engine speed $\hat{N}$(tn) obtained by the estimating means 15 and an estimated pressure $\hat{P}$(tn) in the chamber 2a calculated in the means 17 for calculating the estimated inner pressure therein.

Thus, the throttle valve passing estimated air quantity $\hat{M}$at(tn) is represented as $$Mat = C \cdot A \cdot \Psi \sqrt{Pa \cdot \rho a} \quad (5)$$

where

C: air flow quantity coefficient
A: air passage sectional area
Ψ: Reynold's number
Pa: atmospheric pressure
ρa: atmospheric air density In the equation (5), with respect to the Reynold's number Ψ, when $P/Pa > \{2/(k+1)\}^{1/(K-1)}$, $$\Psi = \sqrt{\frac{2gk}{k-1}\left\{\left(\frac{P}{Pa}\right)^{2/K} - \left(\frac{P}{Pa}\right)^{(K+1)/K}\right\}}$$

and when $P/Pa < \{2/(k+1)\}^{1/(K-1)}$, $$\Psi = \sqrt{\{2gk/(K+1)\} \cdot \{2/(K+1)\}^{1/(K-1)}}$$

where k: coefficient
g: air weight

In the means 16 for calculating the throttle valve passing estimated air quantity, there are provided an air passage sectional area table $TB_A$ for storing the air passage sectional area A preliminarily obtained through experiment with the throttle valve opening degree α as a parameter. The means 16 also has flow quantity coefficient map MPc for storing the flow quantity coefficient C obtained through experiment with the throttle valve opening degree u and the engine speed N as parameters. There are also provided a Reynold's number map MPΨ wherein the Reynold's number Ψ is obtained through experiment with the inner pressure P and the atmospheric pressure Pa as parameters. However, in FIG. 1, the atmospheric pressure Pa is considered to be a normal pressure and only the inner pressure P is considered as a parameter.

In the means 16, the air passage sectional area A is read from the air passage sectional area table $TB_A$ with the estimated throttle valve opening degree $\hat{\alpha}(tn)$, calculated by the estimating means 15. The air flow quantity coefficient C is retrieved from the flow quantity coefficient map MPc with the estimated throttle valve opening degree $\hat{\alpha}(tn)$ and the estimated engine speed $\hat{N}(tn)$. The Reynold's number $\Psi$ is retrieved from the Reynold's number map MP$\Psi$ with the estimated inner pressure $\hat{P}(tn)$ calculated by the means 17.

The air quantity $\hat{M}at(tn)$ is calculated in the calculating element 16a in accordance with the equation (5) on the basis of the air passage sectional area A, the air flow quantity coefficient C and the Reynold's number $\Psi$.

The estimated pressure calculating means 17 is provided with a coefficient table TB·R·T/V for storing a coefficient R·T/V obtained through experiment with an intake air temperature T and also provided with a calculating element 17a for calculating, with the intake air temperature T detected by the intake air temperature sensor 5, the estimated pressure $\hat{P}(tn+1)$ in dependency on the coefficient retrieved from the coefficient table TB·R·T/V, the air quantity Mat(tn) calculated by the air quantity calculating means 16, and the estimated air quantity $\hat{M}at(tn)$ in the cylinder calculated by the means 18 for calculating the estimated air quantity.

In the means 18, the estimated air quantity $\hat{M}ap(tn)$ is calculated in accordance with the following equation.

$$Map = \frac{D}{2 \cdot R \cdot T} \cdot N \cdot \eta v \cdot P \qquad (6)$$

where

D: stroke volume (piston displacement)

N: engine speed $\eta$v: volumetric efficiency

Thus, the coefficient D/2·R·T is considered to be a function of the intake air temperature T, so that the coefficient D/2·R·T can be preliminarily obtained through experiment from the coefficient table TB·D/2·R·T with the intake air temperature T. The volumetric efficiency $\eta$v is also preliminarily obtained through experiment with the engine speed N and the throttle valve opening degree $\alpha$ and is then stored in the volumetric efficiency map MP$\eta$v.

The calculating means 18 is also provided with a calculating element 18a for retrieving the coefficient D/2·R·T from the coefficient table TB·D/2·R·T on the basis of the equation (6). The calculating element 18a retrieves the volumetric efficiency $\eta$v from the volumetric efficiency map MP$\eta$v with the engine speed $\hat{N}$ and the throttle valve opening degree $\alpha$ estimated in the estimating means 15. The calculating element 18a further calculates the estimated air quantity $\hat{M}ap(tn)$ from the estimated engine speed $\hat{N}(tn)$ and the estimated pressure $\hat{P}(tn)$ calculated in accordance with the program in the preceding cycle of time of the estimated pressure calculating means 17.

The estimated air quantity $\hat{M}ap(tn)$ is calculated in accordance with the following equation:

$$\hat{M}ap(tn) = \frac{D}{2 \cdot R \cdot T} \cdot N \cdot \eta v \cdot \hat{P}(tn) \qquad (6')$$

The means 19 for calculating air quantity passing through the throttle valve, the means 20 for calculating pressure in the chamber 2a, and the means 21 for calculating air quantity in the cylinder are also provided with the maps MPc, MP$\Psi$, MP$\eta$v and the tables $TB_A$, TB·R·T/V, TB·D/2·R·Tf as provided for the respective calculating means 16, 17 and 18.

The respective calculating means 19, 20 and 21 shown in FIG. 3 perform the calculations in response to the throttle valve opening degree $\alpha(tn')$, the engine speed N(tn'), and the intake air temperature T at a time when the reference crank angle (REF2) signal on the intake stroke detecting the projection 11b of the crank rotor 11 is output from the crank angle sensor 12. However, since the intake air temperature T has less displacement per unit time, a sampling cycle may be long in comparison with the engine speed N.

In the air quantity calculating means 19, the air passage sectional area A is retrieved from the air passage sectional area table $TB_A$ with the throttle valve opening degree $\alpha(tn')$. The air flow coefficient C is retrieved from the flow coefficient map MPc with the throttle valve opening degree $\alpha(tn')$ and the engine speed N(tn'). And the Reynold's number $\Psi$ is retrieved from the Reynold's number map MP$\Psi$ with the pressure P(tn') detected by the pressure calculating means 20.

The calculating means 19 is provided with a calculating element 19a for calculating the throttle valve passing air quantity Mat(tn') in accordance with the equation (5).

In the means 20 for calculating the pressure in the chamber 2a, the coefficient RT/V is retrieved from the coefficient table TB·RT/V with the intake air temperature T. The calculating means 20 is provided with a calculating element 20a for calculating the pressure P(tn'+1) in accordance with the equation (3) in response to the coefficient RT/V, the throttle valve passing air quantity Mat(tn') calculated by the calculating means 19, and the air quantity Map(tn') calculated by the calculating means 21.

In the calculating means 21, the coefficient D/2·R·T is retrieved from the coefficient table TB·D/2·R·T with the intake air temperature T. The volumetric efficiency $\eta$n is retrieved from the volumetric efficiency map MP$\eta$v with the engine speed N(tn') and the throttle valve opening degree $\alpha(tn')$. Accordingly the air quantity Map(tn') is calculated as follows in accordance with the equation (6)in response to the pressure P(tn') calculated on the basis of the proceeding program of the calculating means 20 and the throttle valve opening degree $\alpha(tn')$.

$$Map(tn') = \frac{D}{2 \cdot R \cdot T} \cdot N \cdot \eta v \cdot P(tn') \qquad (6'')$$

In the basic fuel injection calculating means 22, the basic fuel injection quantities $\hat{T}p$ and Tp ($\hat{T}p = \hat{M}ap/A/F$; $Tp = Map/A/F$) as the desired air-fuel ratio A/F are respectively calculated from the estimated air quantity Map (tn) and the air quantity Map(tn').

The air-fuel ratio feedback correction coefficient setting means 23 reads the output signal from the air-fuel ratio sensor 9 and sets the air-fuel ratio feedback correction coefficient K by the proportion-integration (PI) control.

The fuel injection quantity calculating means 24 carries out the feed back correction of the respective basic fuel injection quantities $\hat{T}p$ and Tp calculated by the calculating means 22 in dependency on the air-fuel ratio feedback correction coefficient KFB set by the air-fuel ratio feedback correction coefficient setting means 23 and calculates the fuel injection quantities $\hat{T}i$ and $\hat{T}i$ ($\hat{T}i=\hat{T}p \cdot KFB$; $Ti=Tp \cdot KFB$).

Fuel injection pulse signal is output based on the fuel injection quantity $\hat{T}i$ to the injector 7.

In the asynchronous interrupt injection calculating means 25, the fuel injection quantities $\hat{T}i$ and Ti calculated by the fuel injection quantity calculating means 24 are compared. In case of $\hat{T}i<TI$ and $\hat{T}i<T180$ (lapse time for the rotation of 180° CA), a fuel injection signal corresponding to the difference $\Delta Ti$ ($\Delta Ti=Ti-\hat{T}i$) is transmitted to the injector 7.

To the contrary, in case of $\hat{T}i<T180$ or $\hat{T}i>Ti$, the interrupt injection is not carried out.

Namely, as shown in FIGS. 5A to 5E, the regular fuel injection starts at a time when a signal representing the reference crank angle REF1 before the fuel induction stroke of the #1 cylinder is generated by the crank angle sensor 12. On the other hand, the asynchronous interrupt injection starts at a time when a signal representing the reference crank angle REF2 on the intake stroke is generated by the sensor 12. Both the reference crank angle signals REF1 and REF2 are output in accordance with the detection of the projections 11*a* and 11*b* of the crank rotor 11. Both the projections 11*a* and 11*b* have 180° CA phase as shown in FIG. 3. Accordingly, in a case where the fuel injection quantity $\hat{T}i$ is larger than T180, the asynchronous interrupt fuel injection cannot be carried out. In addition, the asynchronous interrupt fuel injection quantity $\Delta Ti$ calculated from the difference between $\hat{T}i$ and Ti cannot be calculated, even in a case where the fuel injection quantity $\hat{T}i$ is less than T180, but the fuel injection quantity $\hat{T}i$ is larger than the fuel injection quantity Ti. Therefore, in such case, the asynchronous interrupt fuel injection is not carried out.

The control sequence of the fuel injection control means 14 will be described hereunder with reference to the flowchart of FIG. 2.

Figure 2B:
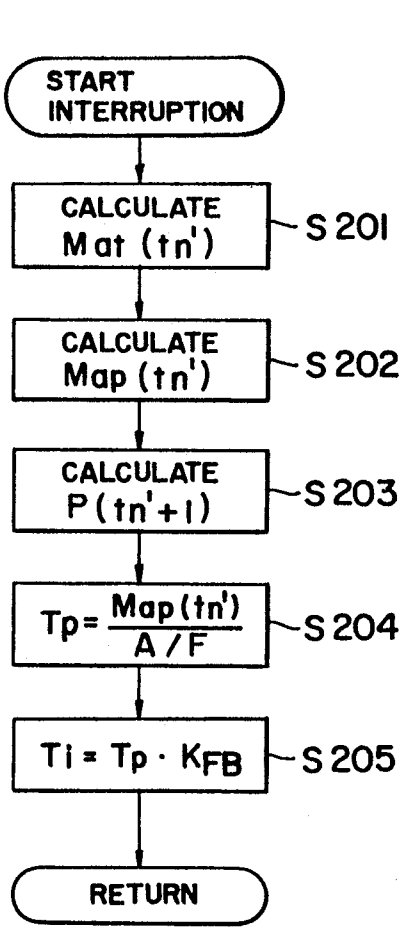
FIGS. 2A and 2B show flowcharts representing operational sequences of the fuel injection control system.
Figure 2A:
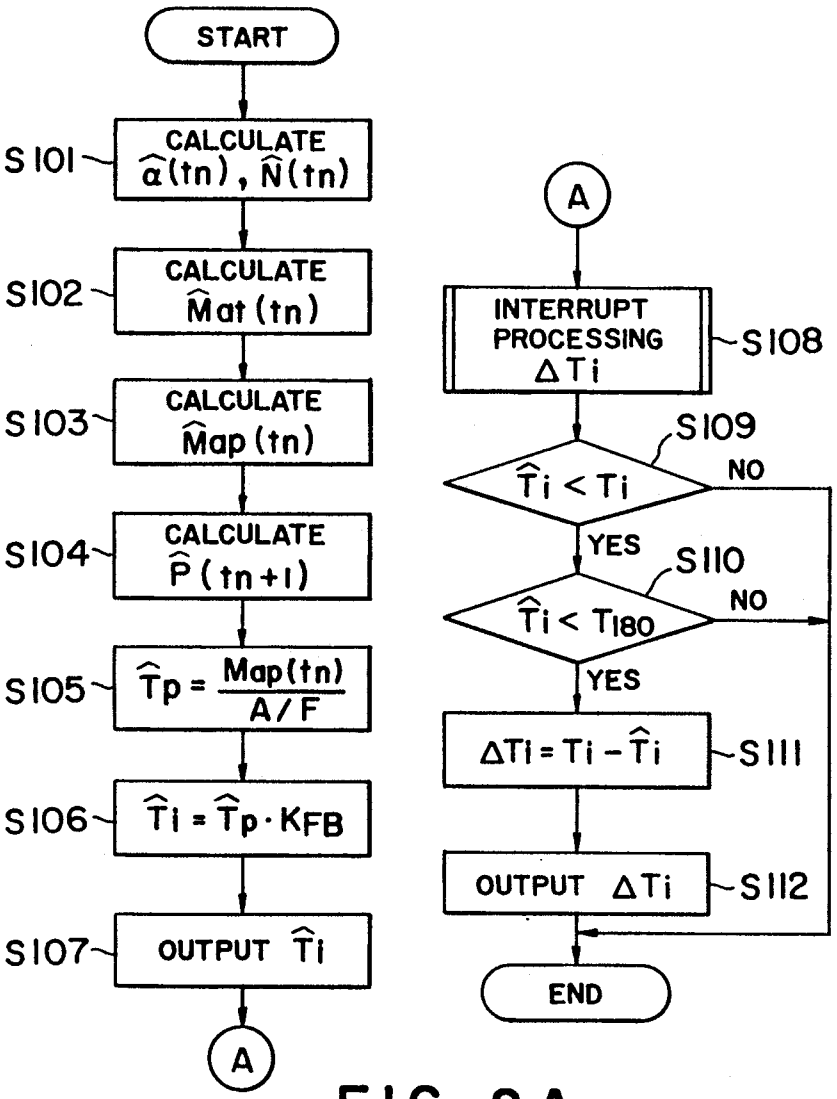

Referring to FIG. 2A, at the step S101, when the signal REF1 of the reference crank angle before the intake stroke is output, the estimated throttle opening degree $\hat{\alpha}(tn)$ and the estimated engine speed $\hat{N}(tn)$ are calculated in response to the opening degree $\alpha(tn)$ and the engine speed N(tn), respectively.

At the step S102, the estimated air quantity $\hat{M}at(tn)$ is calculated from the estimated throttle opening degree $\hat{\alpha}(tn)$ and the estimated engine speed $\hat{N}(tn)$ calculated at the step S101 and the estimated pressure $\hat{P}(tn)$ calculated at the step S104.

Thereafter, at the step S103, the air quantity $\hat{M}ap(tn)$ is calculated in accordance with the estimated throttle opening degree $\hat{\alpha}(tn)$ and the estimated engine speed $\hat{N}(tn)$ calculated at the step S101, the intake air temperature T, and the estimated pressure $\hat{P}(tn)$ calculated at the step S104 of the preceding program.

At the step S104, the present estimated pressure $\hat{P}(tn+1)$ is calculated in accordance with the intake air temperature T, the throttle valve passing estimated air quantity $\hat{M}at(tn)$ calculated the step S102, and the estimated air quantity $\hat{M}ap(tn)$ calculated at the step S103.

Thereafter, at the step S105, the basic fuel injection quantity $\hat{T}p$ for the basis of the desired air-fuel ratio A/F preliminarily set is calculated ($\hat{T}p=\hat{M}ap(tn)/A/F$) in accordance with the estimated air quantity $\hat{M}ap(tn)$ calculated at the step S103.

At the step S106, the fuel injection quantity $\hat{T}i$ is calculated by correcting the basic injection quantity $\hat{T}p$ calculated at the step S105 with the air-fuel ratio feedback correction coefficient KFB ($\hat{T}i=\hat{T}p=KFB$).

At the step S107, the fuel injection pulse based on the fuel injection quantity $\hat{T}i$ is output to the injector 7.

An interrupt processing of the asynchronous interrupt fuel injection quantity is carried out at the step S108 when the signal REF2 of the reference crank angle on the intake stroke is output.

The interrupt processing will be represented by the flowchart of FIG. 2B.

First, at the step S201, the air quantity Mat(tn') passing the throttle valve is calculated from the throttle opening degree $\alpha(tn')$ and the engine speed N(tn') calculated at a time when the reference crank angle signal REF2 is generated on the intake stroke, and the pressure P(tn') calculated at the step 203 of the proceeding program.

Thereafter, at the step S202, the air quantity Map(tn') is calculated from the throttle opening degree $\alpha(tn')$ and the engine speed N(tn'), the intake air temperature T, and the pressure P(tn') calculated at the step S203 of the proceeding program.

At the step S203, the present pressure P(tn+1) is calculated in accordance with the intake air temperature T, the throttle valve passing air quantity Mat(tn') calculated at the step S201, and the air quantity Map(tn') calculated at the step S202.

Thereafter, the step proceeds to the step S204, the basic fuel injection quantity Tp for the basis of the desired air-fuel ratio A/F preliminarily set is calculated ($Tp=Map(tn')/A/F$) in accordance with the air quantity Map(tn') calculated at the step S202.

At the next step S205, the fuel injection quantity Ti is calculated by correcting basic injection quantity Tp calculated at the step S204 with the air-fuel ratio feedback correction coefficient KFB (Ti=Tp KFB).

In accordance with the steps, the interrupt processing is completed.

The completion of the interrupt processing, back to the steps of the flowchart of FIG. 2A, at the step S109, the fuel injection quantity $\hat{T}i$ calculated at the step S106 and the fuel injection quantity Ti calculated at the step S205 are compared. And in case of $\hat{T}i<Ti$, the next step S110 starts, whereas in case of $\hat{T}i \geqq Ti$, the program is completed as shown in FIG. 2A.

At the step S110, the pulse cycle of the fuel injection quantity Ti calculated at the step S106 and the T180 (lapsed time for the rotation of 180° CA) are compared. In case of $\hat{T}i \geqq T180$, the program is completed, whereas in case of $\hat{T}i \leqq T180$, the next step S111 starts. The asynchronous interrupt fuel injection quantity $\Delta Ti$ ($\Delta Ti=Ti-\hat{T}i$) is calculated from the difference between the fuel injection quantities $\hat{T}i$ and Ti.

At the step S112, the fuel injection pulse in accordance with the asynchronous interrupt fuel injection quantity Ti calculated at the step S111 is output to the injector 7.

Figures 5A, 5B, 5C, 5D, 5E:
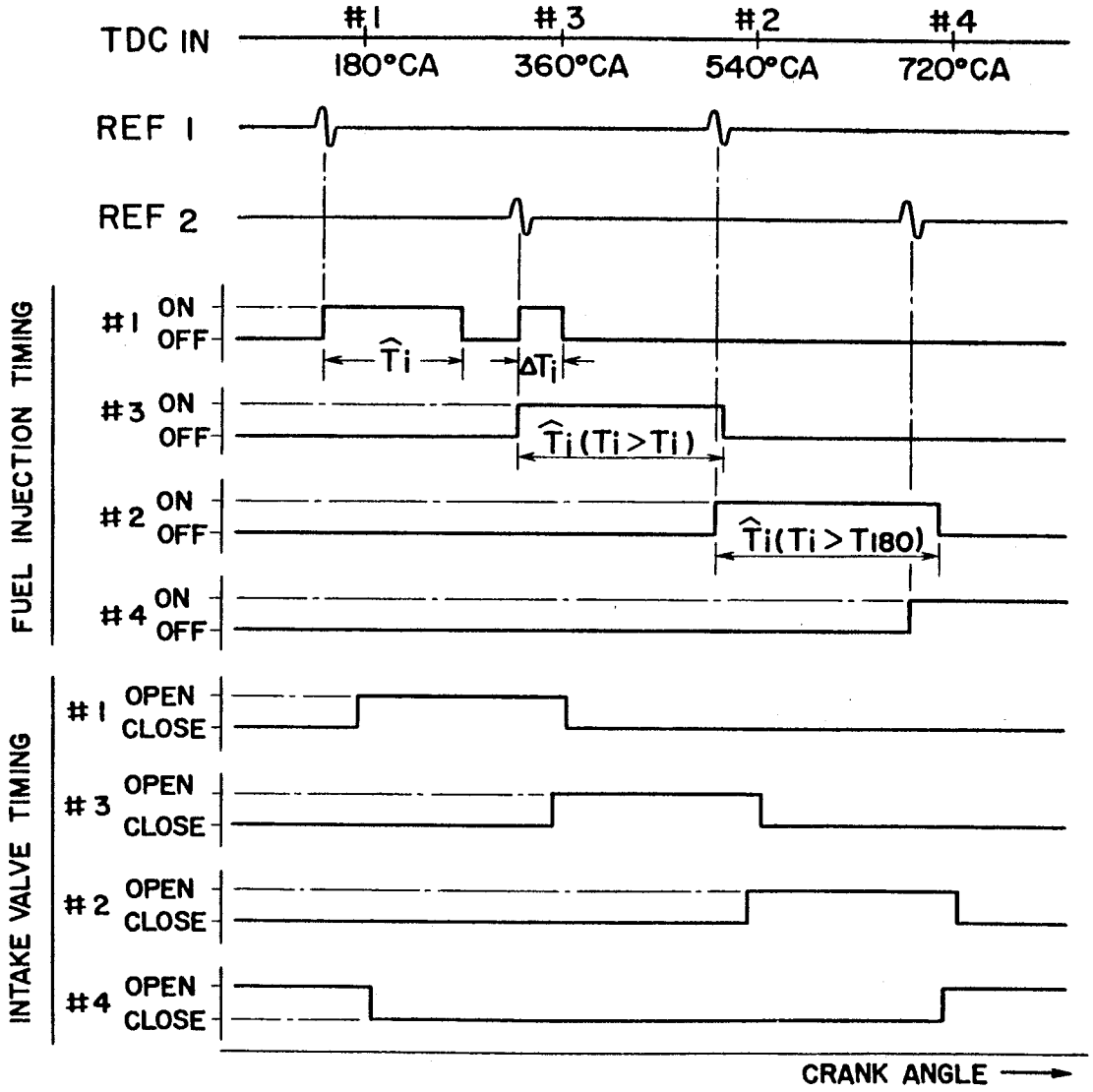
FIGS. 5A to 5E are time charts showing fuel injection timing.

As described hereinbefore, as shown with respect to the #1 cylinder in FIG. 5D, in a case where it is discriminated that the fuel injection quantity $\hat{T}i$ estimated before the intake stroke becomes short as the calculation result of the fuel injection quantity Ti on the intake stroke, the interrupt injection of the fuel corresponding to the underquantity is carried out on the intake stroke.

Figure 6A:
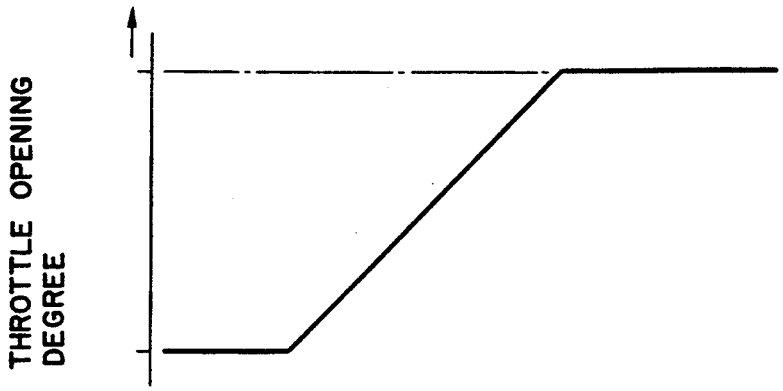
FIGS. 6A to 6C are graphs representing changing characteristics of a throttle valve opening degree, an intake air quantity and an air-fuel ratio, respectively.
Figure 6B:
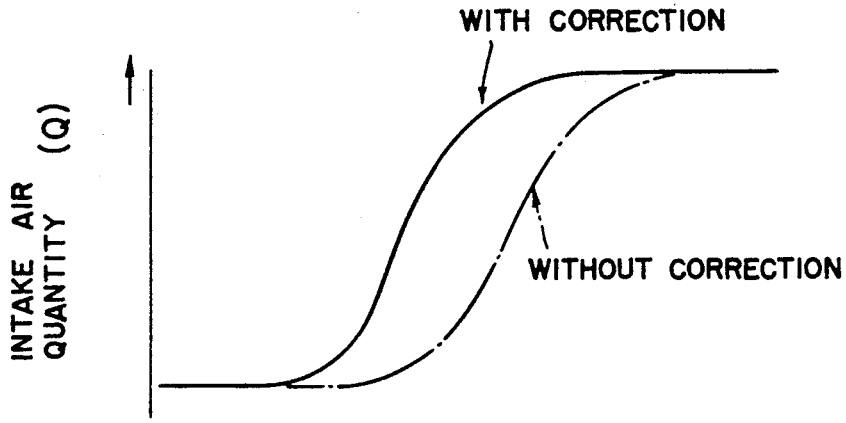
Figure 6C:
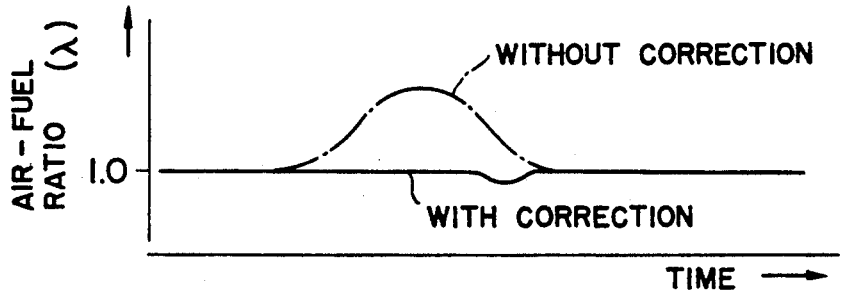

As a result, as shown in FIG. 6C, the air-fuel ratio control characteristic in the transient state can be remarkably improved in comparison with the case where no correction of the injection quantity is made on the intake stroke. In addition, as shown in FIG. 6B, the intake air quantity in the transient state changes from the air quantity with delay to the air quantity substantially the same as the actually induced air quantity. Accordingly, the control characteristic of the ignition cycle set on the basis of the intake air quantity and the engine speed can be also improved.

While the presently preferred embodiment of the present invention has been shown and described, it is to be understood that this disclosure is for the purpose of illustration and that various changes and modifications may be made without departing from scope of the invention as set forth in the appended claims.

What is claimed is:

1. A system for controlling fuel injection of an engine having a plurality of cylinders, an intake passage for inducing air and fuel mixture into at least one of said cylinders, a throttle valve provided in said intake passage for controlling an amount of air, and a fuel injector provided in said intake passage for injecting fuel, comprising:

engine speed sensing means for detecting a first engine speed at a first reference crank angle before an intake stroke cycle of the engine and a second engine speed at a second reference crank angle in said intake stroke cycle;

throttle position sensing means for sensing a first throttle opening degree at said first reference crank angle and a second throttle opening degree at said second reference crank angle;

estimating means for estimating what an estimated throttle opening degree and an estimated engine speed will be for said engine after a predetermined time period in said intake stroke cycle has lapsed, based on said first throttle opening degree and said first engine speed, respectively;

first air quantity calculating means responsive to said estimated throttle opening degree and said estimated engine speed for calculating a first air quantity which will be induced in said cylinder during said intake stroke cycle;

second air quantity calculating means responsive to said second engine speed and said second throttle opening degree for calculating a second air quantity induced in said cylinder during said intake stroke cycle;

fuel injection quantity calculating means for calculating a first fuel injection quantity in accordance with said first air quantity, which first fuel injection quantity is injected from the point of said first crank reference angle, and for calculating a second fuel injection quantity in accordance with said second air quantity; and synchronous interrupted fuel injection quantity calculating means for calculating an synchronous interrupted fuel injection quantity in accordance with a difference value between said first and second fuel injection quantity, which synchronous interrupted fuel injection quantity is injected from the point of said second crank reference angle.

2. The system according to claim 1, wherein said fuel injection quantity calculating means comprises setting means for setting an air-fuel ratio feedback correction coefficient to correct at least said first fuel injection quantity.

3. The system according to claim 1 further comprising:

intake air temperature sensing means for detecting a first intake air temperature at said first reference crank angle and a second intake air temperature at said second reference crank angle;

said first air quantity calculating means further responsive to said first intake air temperature for calculating said first air quantity; and said second air quantity calculating means further responsive to said second intake air temperature for calculating said second air quantity.

4. The system according to claim 3, wherein said first air quantity calculating means comprises:

a first calculator for calculating an estimated air quantity passing said throttle valve after said predetermined time;

a second calculator for calculating an estimated pressure in said intake passage said predetermined time later;

a third calculator for calculating said first air quantity in said cylinder;

said first calculator responsive to said estimated throttle opening degree, said estimated engine speed, said first intake air temperature and a latest value of said estimated pressure;

said second calculator responsive to said first intake air temperature and latest values of said estimated air quantity and said first air quantity; and said third calculator responsive to said estimated throttle opening degree, said estimated engine speed, said first intake air temperature and a latest value of said estimated pressure.

5. The system according to claim 4, wherein said first calculator comprises:

an air passage sectional area table for producing an air passage sectional area in response to said estimated throttle opening degree;

a flow quantity coefficient map for producing a flow quantity coefficient in response to said estimated throttle opening degree and said estimated engine speed;

a Reynold's number map for producing Reynold's number in response to said estimated pressure; and a device for calculating said estimated air quantity passing said throttle valve in response to said air passage sectional area, said flow quantity coefficient and said Reynold's number.

6. The system according to claim 4, wherein said second calculator comprises:

a coefficient table for producing a coefficient in response to said first intake air temperature; and a device for calculating said estimated pressure in response to said coefficient, said latest values of said estimated air quantity and said first air quantity.

7. The system according to claim 4, wherein said third calculator comprises:

a coefficient table for producing a coefficient in response to said estimated throttle opening degree and said estimated engine speed;

a volumetric efficiency map for producing a volumetric efficiency in response to said first intake air temperature; and a device for calculating said first air quantity in response to said coefficient, said volumetric efficiency, estimated engine speed and said latest value of said estimated pressure.

8. The system according to claim 3, wherein said second air quantity calculating means comprises:

a fourth calculator for calculating an air quantity passing said throttle valve at said second reference crank angle;

a fifth calculator for calculating an pressure in said intake passage at said second reference crank angle;

a sixth calculator for calculating said second air quantity in said cylinder;

said fourth calculator responsive to said second throttle opening degree, said second engine speed, said second intake air temperature and a latest value of said pressure in said intake passage;

said fifth calculator responsive to said second intake air temperature and latest values of said air quantity and said second air quantity; and said sixth calculator responsive to said second throttle opening degree, said second engine speed, said second intake air temperature and a latest value of said pressure in said intake passage.

9. The system according to claim 8, wherein said fourth calculator comprises:

an air passage sectional area table for producing an air passage sectional area in response to said second throttle opening degree;

a flow quantity coefficient map for producing a flow quantity coefficient in response to said second throttle opening degree and said second engine speed;

a Reynold's number map for producing Reynold's number in response to said latest value of said pressure in said intake passage; and a device for calculating said air quantity passing said throttle valve at said second reference crank angle in response to said air passage sectional area, said flow quantity coefficient and said Reynold's number.

10. The system according to claim 8, wherein said fifth calculator comprises:

a coefficient table for producing a coefficient in response to said second intake air temperature; and a device for calculating said pressure in said intake passage in response to said coefficient and said latest values of said air quantity passing said throttle valve at said second crank angle and said second air quantity.

11. The system according to claim 8, wherein said sixth calculator comprises:

a coefficient table for producing a coefficient in response to said second throttle opening degree and said second engine speed;

a volumetric efficiency map for producing a volumetric efficiency in response to said second intake air temperature; and a device for calculating said first air quantity in response to said coefficient, said volumetric efficiency, second engine speed and said latest value of said pressure in said intake passage.

12. The system according to claim 1, wherein said asynchronous interrupted fuel injection quantity calculating means comprises:

a first comparator for comparing said first and second fuel injection quantities;

a second comparator for comparing said first fuel injection quantity with a preset value; and a calculator for calculating said difference value when said first fuel injection quantity is smaller than each of said second fuel injection quantity and said preset value.

13. The system according to claim 12, wherein said second comparator is adapted to respond to said preset value of 180 degrees crank angle.

14. A method for controlling fuel injection of an engine having a plurality of cylinders, an intake passage for inducing air and fuel mixture into at least one of said cylinders, a throttle valve provided in said intake passage for controlling an amount of air and a fuel injection provided in said intake passage for injecting fuel, said method comprising:

sensing a first engine speed at a first reference crank angle before an intake stroke cycle of the engine;

sensing a first throttle opening degree at said first reference crank angle;

estimating what an estimated throttle opening degree and an estimated engine speed will be for said engine after a certain time period in said intake stroke cycle has lapsed, based on said first throttle opening degree and said first engine speed, respectively;

calculating a first air quantity which will be induced in said cylinder during said intake stroke cycle in response to said estimated throttle opening degree and said estimated engine speed;

calculating a first fuel injection quantity in accordance with said first air quantity;

injecting said first fuel injection quantity from the point of said first crank reference angle;

sensing a second engine speed at a second reference crank angle in said intake stroke cycle;

sensing a second throttle opening degree at said second reference crank angle;

calculating a second air quantity induced in said cylinder during said intake stroke cycle in response to said second engine speed and said second throttle opening degree;

calculating a second fuel injection quantity in accordance with said second air quantity;

calculating an asynchronous interrupted fuel injection quantity in accordance with a difference value between said first and second fuel injection quantity; and injecting said asynchronous interrupted fuel injection quantity from the point of said second crank reference angle.

* * * * *